US008677668B1

(12) United States Patent
Caldwell

(10) Patent No.: US 8,677,668 B1
(45) Date of Patent: Mar. 25, 2014

(54) FIREARM LOCKING APPARATUS AND METHOD

(71) Applicant: Joseph Aaron Caldwell, Woody, CA (US)

(72) Inventor: Joseph Aaron Caldwell, Woody, CA (US)

( * ) Notice: Subject to any disclaimer, the term of this patent is extended or adjusted under 35 U.S.C. 154(b) by 0 days.

(21) Appl. No.: 13/970,528

(22) Filed: Aug. 19, 2013

(51) Int. Cl.
*F41A 17/00* (2006.01)
*F41A 17/44* (2006.01)

(52) U.S. Cl.
CPC ..... *F41A 17/44* (2013.01)
USPC ..... 42/70.11; 42/70.01; 42/66

(58) Field of Classification Search
CPC ..... F41A 17/44
USPC ..... 42/70.01, 70.11, 66
See application file for complete search history.

(56) References Cited

U.S. PATENT DOCUMENTS

| | | | | |
|---|---|---|---|---|
| 4,398,366 | A | 8/1983 | Wernicki | |
| 5,241,770 | A | 9/1993 | Lambert | |
| 6,041,536 | A | 3/2000 | Samuels et al. | |
| 6,212,813 | B1 | 4/2001 | Luna et al. | |
| 6,543,171 | B2 * | 4/2003 | Kellerman | 42/70.11 |
| 6,584,718 | B1 * | 7/2003 | Serrao | 42/70.11 |
| 6,796,071 | B2 * | 9/2004 | Lane et al. | 42/70.11 |
| 6,862,831 | B1 | 3/2005 | Canaday | |
| 6,941,692 | B1 | 9/2005 | Krinke et al. | |
| 7,121,033 | B1 | 10/2006 | Waller | |
| 7,752,796 | B2 | 7/2010 | Ramsey, Sr. | |
| 8,302,435 | B2 | 11/2012 | Burmesch et al. | |
| 2006/0162221 | A1 | 7/2006 | McLaren et al. | |
| 2011/0173860 | A1 | 7/2011 | Arendt | |

* cited by examiner

*Primary Examiner* — Michael David
(74) *Attorney, Agent, or Firm* — James M. Duncan, Esq.; Klein DeNatale Goldner

(57) ABSTRACT

A firearm locking apparatus has a casing body which lodges within the chamber of a firearm, a rod which extends through the length of the barrel of the weapon, and a lock body which attaches to an outward end of the rod extending from the muzzle of the weapon. The lock body is attached such that there is not a sufficient length of exposed portion of the rod between the muzzle of the weapon and the lock body to allow attachment of any commonly known tool to the exposed portion of the rod. When the lock body is locked, it cannot be removed from the outward end of the rod, and the lock body freely spins on the rod. This configuration prevents removal of the rod and casing body from the weapon until the lock body is unlocked and removed, which allows removal of the rod and casing body from the weapon.

14 Claims, 6 Drawing Sheets

FIREARM LOCKING APPARATUS AND METHOD

BACKGROUND OF THE INVENTION

The disclosed device relates generally to safety devices for firearms which are utilized to prevent the discharge of the firearm by children and also to prevent the unintended discharge of the weapon. A large number of devices are known for locking firearms, with the two best known types of device being a trigger lock and a cable lock. The trigger locks function by blocking the trigger while the cable locks typically run through the barrel and ejector port and block access to the chamber.

Both of these types of locks have disadvantages which are known to those in the art. For example, neither of these types of locks works well with revolvers. A second example is that removing the locks can be time consuming. In an emergency where access to a workable firearm is required quickly, removal of the lock and subsequent loading of the weapon can result in significant delay. As yet another problem, the two main types of locks can be overcome by an unauthorized user, sometimes quite quickly. The cable locks can be cut with bolt cutters, and the trigger locks can typically be removed from the trigger housing with a drill, angle grinder, lock picks or similar devices.

SUMMARY OF THE INVENTION

Embodiments of the presently disclosed invention provide a solution to the needs identified above. Embodiments of the apparatus of the present invention comprise a lock body, a rod, and a casing body. When installed within a firearm, the casing body is disposed within the chamber of the firearm, the rod extends from the casing body to just outside of the barrel muzzle, and the lock body attaches to the end of the rod extending outside of the barrel muzzle.

The rod has a threaded first end removably attached to the casing body disposed within the chamber of the weapon. The rod has a second end extending outside of the muzzle end of the barrel of the weapon sufficiently for the lock body to secure the second end. The second end comprises one or more grooves into which a latch member from the lock body is inserted upon activation of a locking mechanism within the lock body, typically upon rotation of a key or activation of a combination. Once the locking mechanism is activated, with the latch member inserted into a corresponding circumferential groove on the second end of the rod, the lock body spins freely upon the rod, but cannot be removed from the second end of the rod without the locking mechanism being unlocked.

The casing body has a rim portion similar to the rim portion of an ammunition cartridge, in which the rim portion provides the extractor of the firearm a structure to grip the casing to remove the expended casing from the weapon chamber. The rim portion also prevents movement of the casing body down the barrel of the weapon toward the muzzle. When disposed within the chamber of the weapon, the casing body is axially aligned with the barrel, the casing body comprising a centrally aligned threaded aperture having an opening facing the muzzle of the weapon.

The locking apparatus has the following attributes: (1) there is a minimal length of exposed rod between the lock body and the end of the barrel, such that the lock body abuts or nearly abuts the end of the barrel, such that there is an insufficient length of exposed rod to allow access for any commonly known tool to grasp any length of exposed rod; (2) once the lock body is placed and locked on the second end of the rod by activation of the locking mechanism within the lock body, a portion of the second end of the rod is captured inside the lock body and the portion of the second end captured within the lock body is not accessible by hand or tool; and (3) once the locking mechanism has been activated, the lock body freely spins on the second end of the rod.

The result of the above configuration is that once the threaded first end of the rod has been inserted into the muzzle of the weapon, slid down the barrel and made up into the threads of the aperture of the casing body and the lock body has been locked onto the second end of the rod, the weapon chamber and barrel will be blocked by the casing body and rod, thereby preventing the chambering of a live round into the action of the weapon and the passing of slug or shot through the barrel. Removal of the rod will be prevented because while the locking mechanism is engaged, the lock body will spin freely on the second end of the rod and there is not a sufficient length of exposed rod to be able to grasp and rotate the rod, thereby backing the threaded first end of the rod out of the threads of the casing body.

Once the locking mechanism is disengaged, the second end of the rod is exposed. The second end of the rod comprises a tool engagement member, such as an aperture extending through the diameter of the rod, thereby allowing a tool, such as a pin, to be inserted into the aperture, facilitating the rotation of the rod for the disengagement of the threaded first end from the threads of the casing body.

DETAILED DESCRIPTION OF THE EMBODIMENTS

Figure 1:
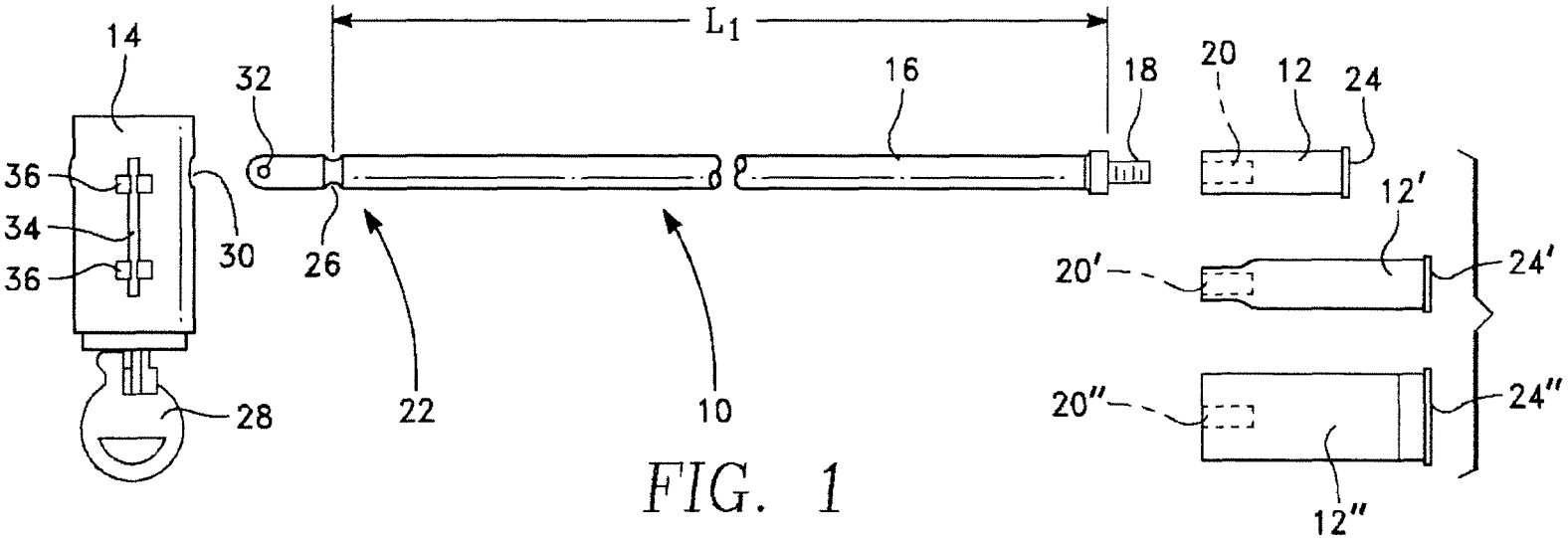
FIG. 1 shows an exploded view of an embodiment of the apparatus, indicating three different dummy casings which may be utilized with the device.
Figure 2:
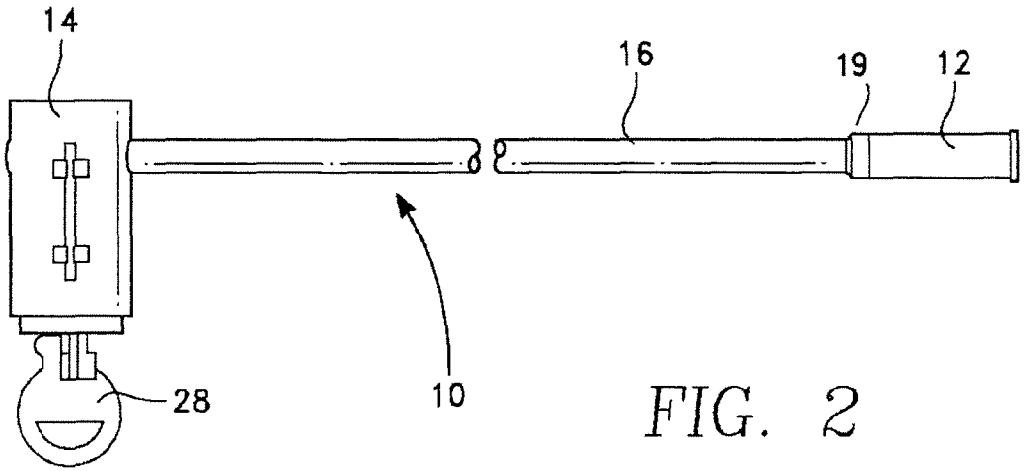
FIG. 2 shows an assembled embodiment of the device.
Figure 3:
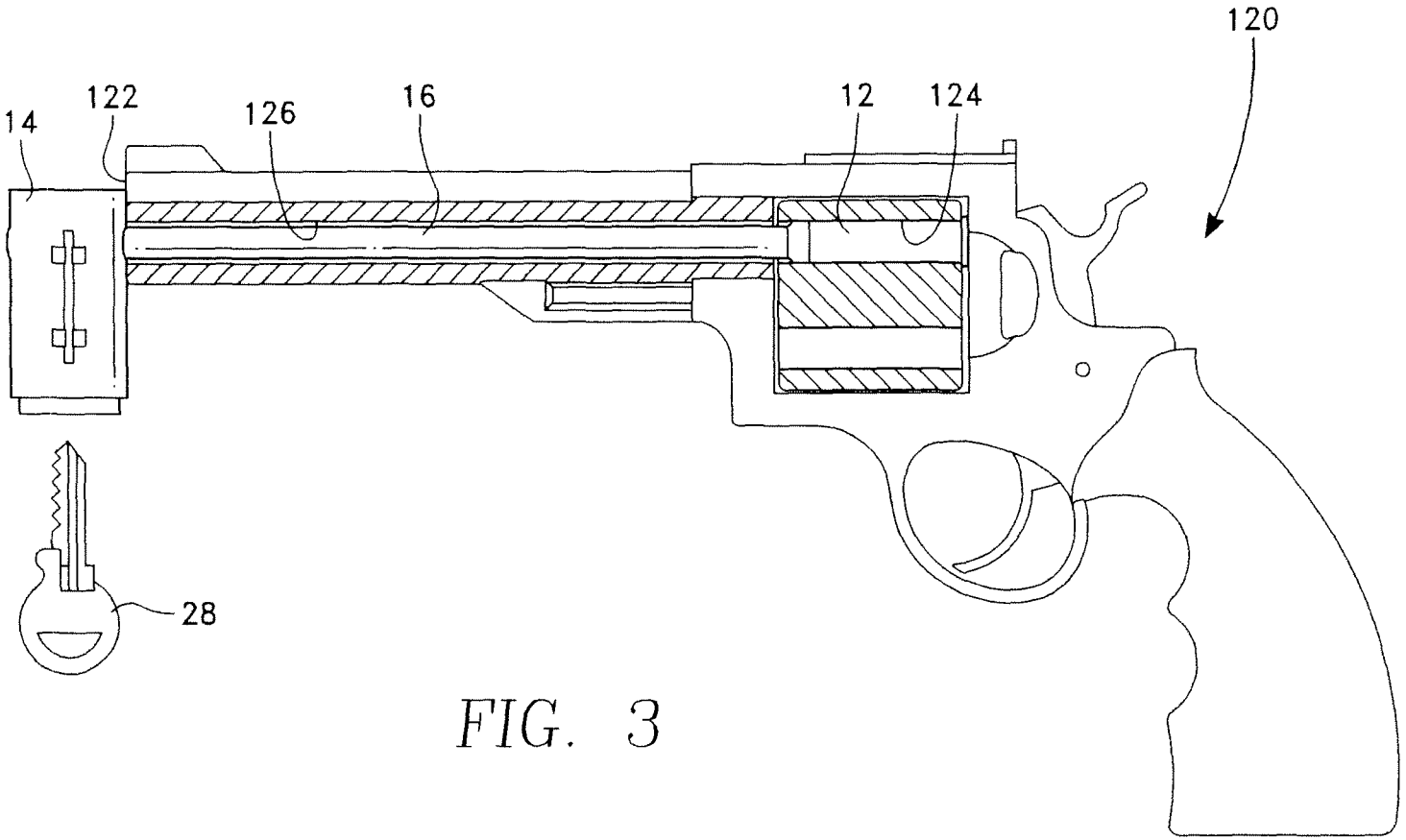
FIG. 3 shows an embodiment of the device installed on a revolver.
Figure 4:
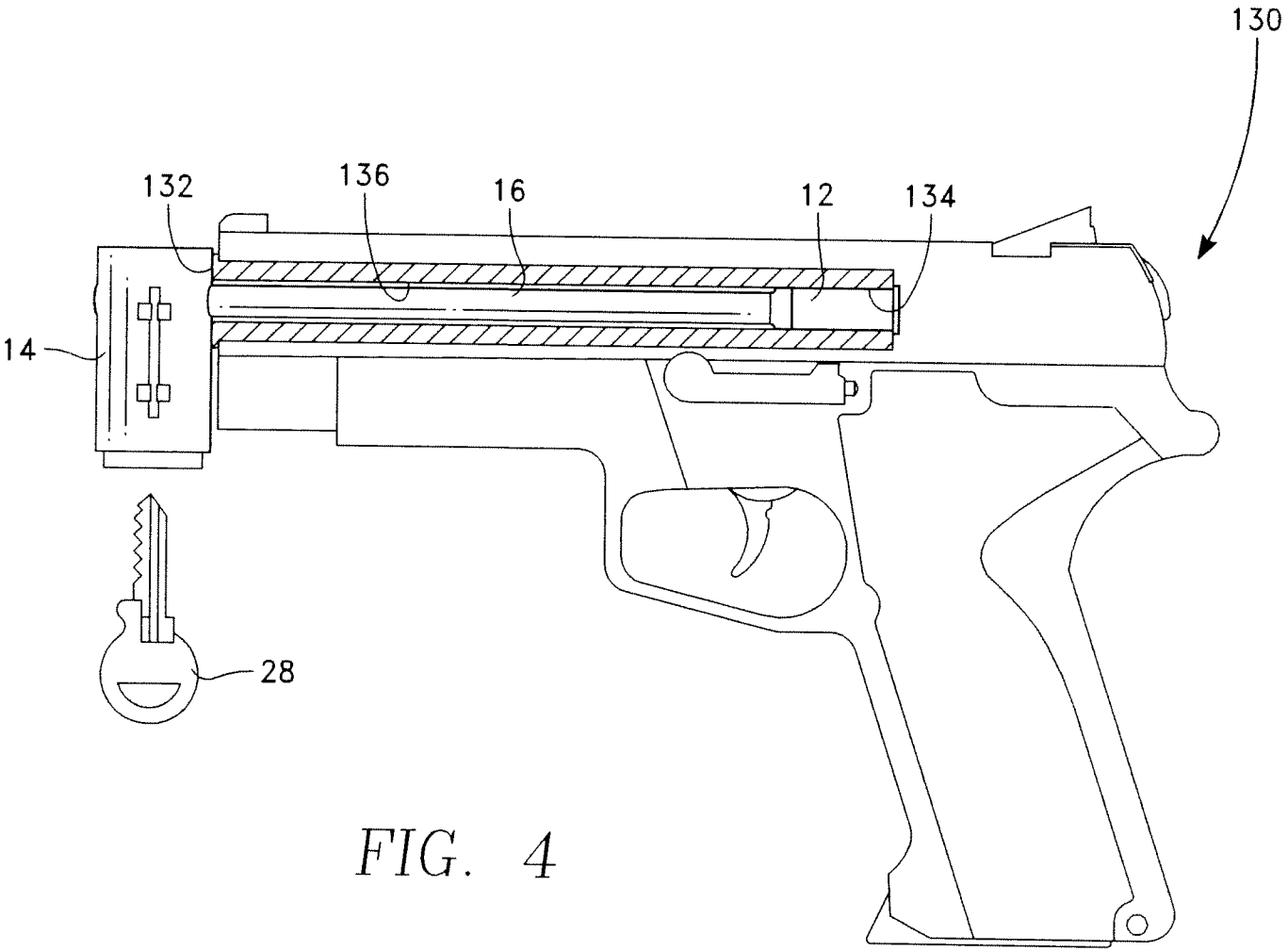
FIG. 4 shows an embodiment of the device installed on a semi-automatic pistol.
Figure 5:
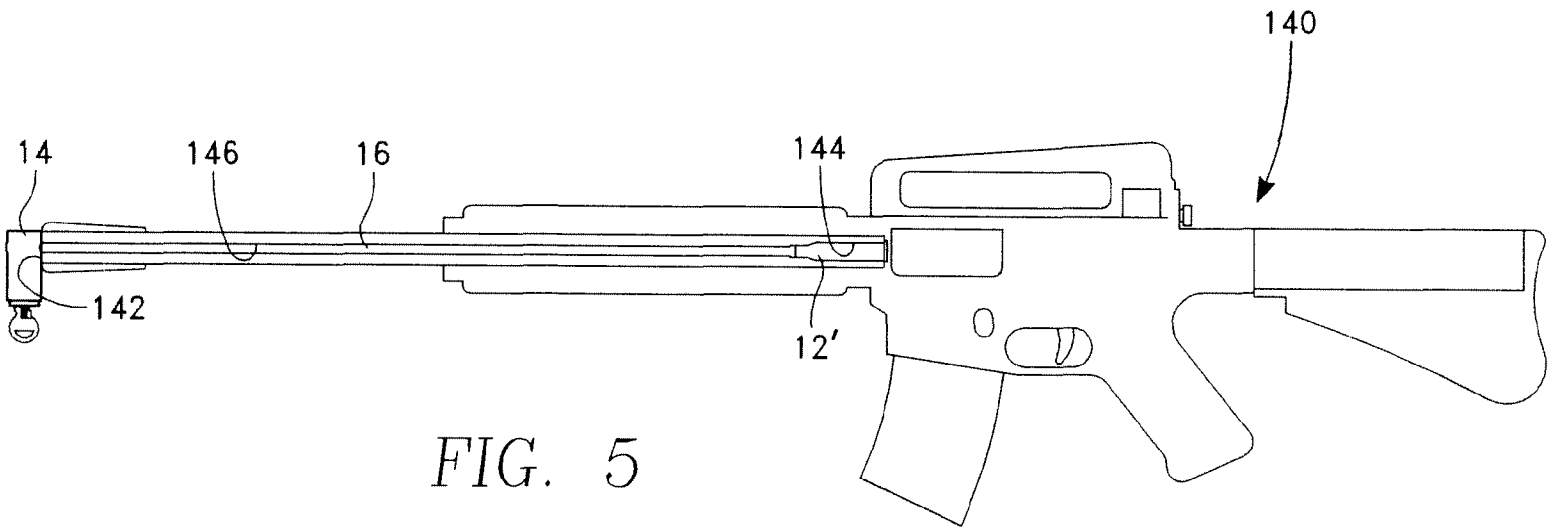
FIG. 5 shows an embodiment of the device installed on a rifle.
Figure 6:
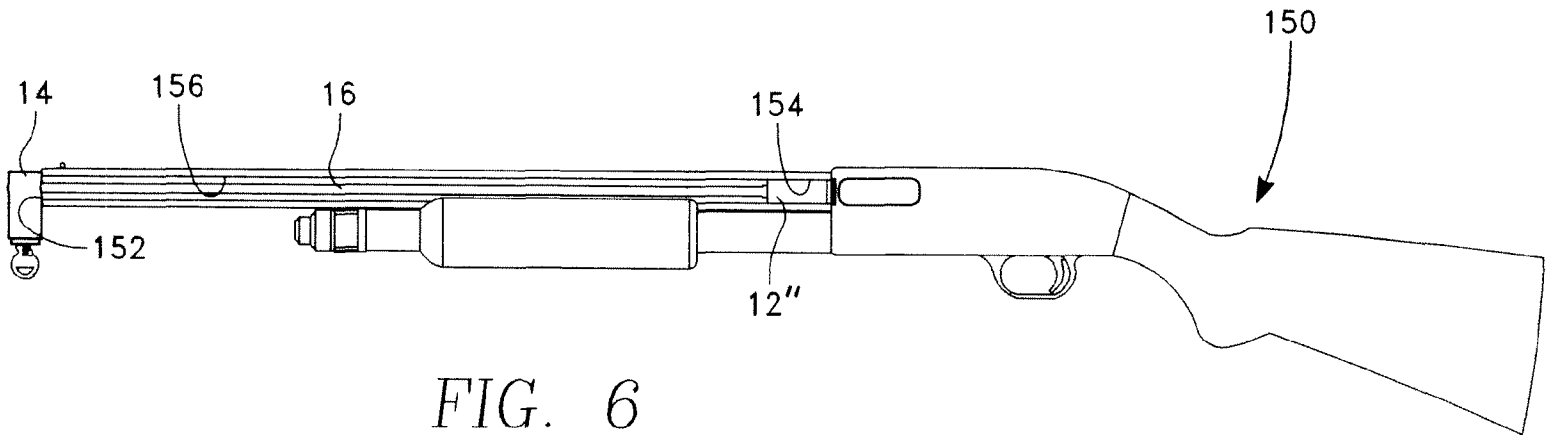
FIG. 6 shows an embodiment of the device installed on a shotgun.

Referring now to the figures, embodiments of the disclosed firearm locking apparatus are depicted. As a general description, the firearm locking apparatus 10 comprises three basic components which are utilized in combination with a firearm. The disclosed firearm locking apparatus 10 may be used with all of the basic firearms available to the civilian population, specifically revolvers 120, semi-automatic pistols 130, rifles 140, and shotguns 150.

The disclosed firearm locking apparatus 10 utilizes structures of the firearm itself to defeat attempts to remove the device by unauthorized users. Specifically, the apparatus utilizes a length of approximately $L_1$ between the chamber of the firearm and the end of the muzzle. The major components of the locking apparatus are casing body 12, lock body 14, and rod 16 which, when installed within a firearm, extends between the casing body and the lock body.

Rod 16 has a threaded end 18 which makes up into an axially-aligned (i.e., aligned with the long axis of the barrel 126) threaded aperture 20 of casing body 12 which is disposed within chamber 124 of revolver 120 or within chamber 134 of semi-automatic pistol 130. Likewise, threaded end 18 may be made up into axially-aligned threaded aperture 20' of the casing body 12' which is disposed within chamber 144 of rifle 140. Threaded end 18 may also be made up into an axially aligned threaded aperture 20" of the casing body 12" which is disposed within chamber 154 of shotgun 154. Threaded end 18 comprises a shoulder member 19 which, when the threads are made up into the threaded aperture 20, 20' or 20", the shoulder abuts the front of the casing body 12, 12', or 12". As shown in FIG. 1, dimension $L_1$ is applied to the locking apparatus 10 as the length along rod member 16 between shoulder member 19, which abuts casing body 12, 12', 12" when threaded end 18 is made up into threaded aperture 20, and the circumferential groove 26 of rod member 16, as illustrated in FIG. 1.

Casing body 12, 12', 12" usually will contain no bullet, propellant, or primer. Casing body 20, 20' or 20" may further comprises a rim portion 24, 24' or 24" which prevents forward movement towards the muzzle by the casing body when the casing body is disposed within the firing chamber of the firearm Casing bodies 12, 12' and 12" will typically not rotate within chambers 124, 134, 144 or 154 of the firearm as the threaded end 18 of the rod is screwed into or out of the threaded aperture because the hammer of the weapon will typically be forward and in contact with the rear of the casing body. This pressure prevents rotation of the casing bodies 12, 12' and 12" as the threaded end 18 is made up into and rotated out of threaded aperture 20. The threaded end need not be tightened beyond an amount easily attainable with the tightening devices described below.

Casing body 12, 12' and 12" comprises a long axis which is axially aligned with a barrel 126, 136, 146, or 156 of a firearm.

Rod 16 also has an outward end 22 a portion of which is received into lock body 14. When installed within a weapon, outward end 22 will extend outside of muzzle 122 of revolver 120, outside of muzzle 132 of semi-automatic pistol 130, outside of muzzle 142 of rifle 140, and outside of muzzle 152 of shotgun 150. Outward end 22 comprises a circumferential groove 26. A portion of rod 16 will be disposed within the barrel 126, 136, 146 and 156 of the applicable weapon, extending within the barrel between the muzzle of the weapon and the casing body 12, 12', or 12".

Figure 7:
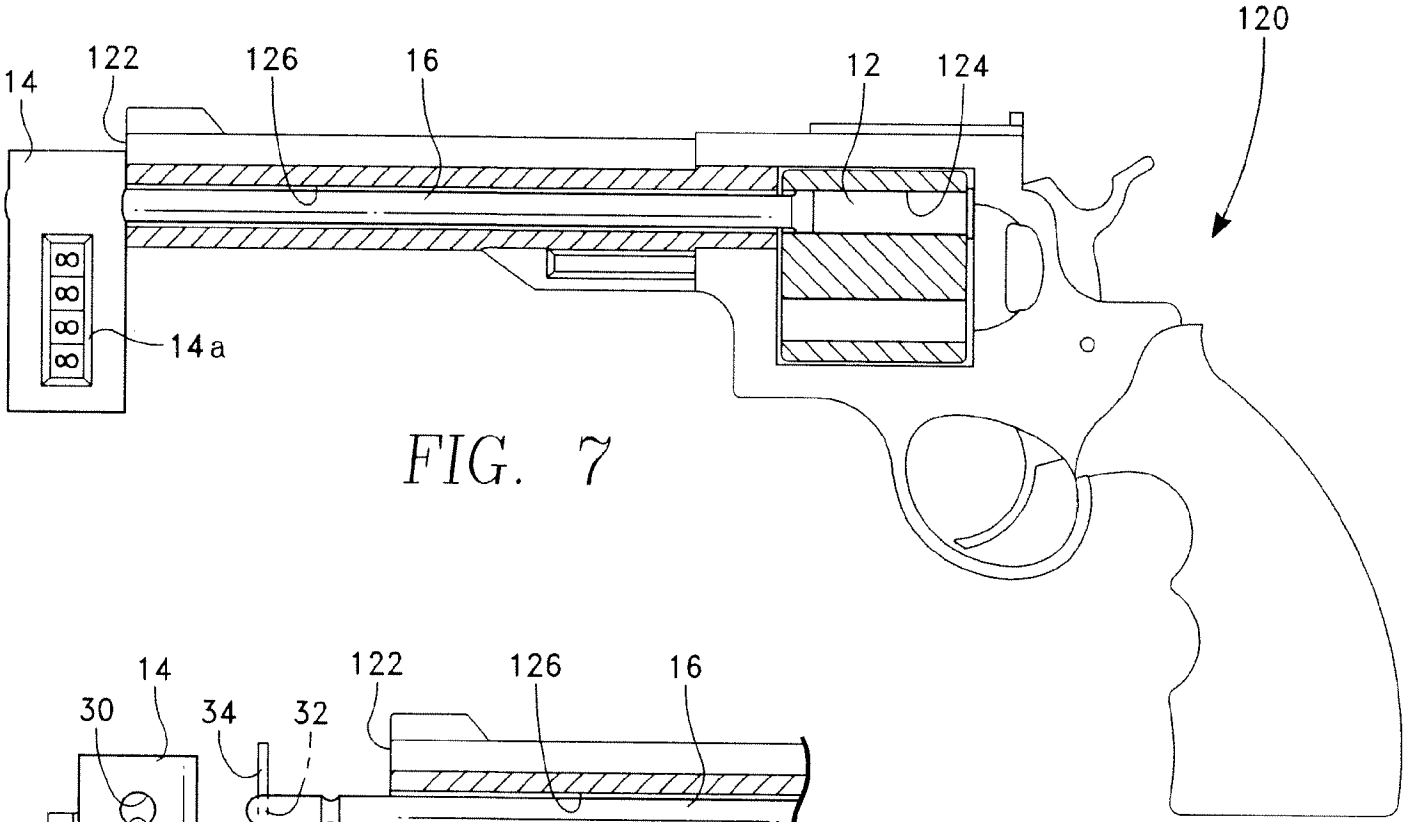
FIG. 7 shows an alternative embodiment of the device which utilizes a combination lock body.
Figure 8:
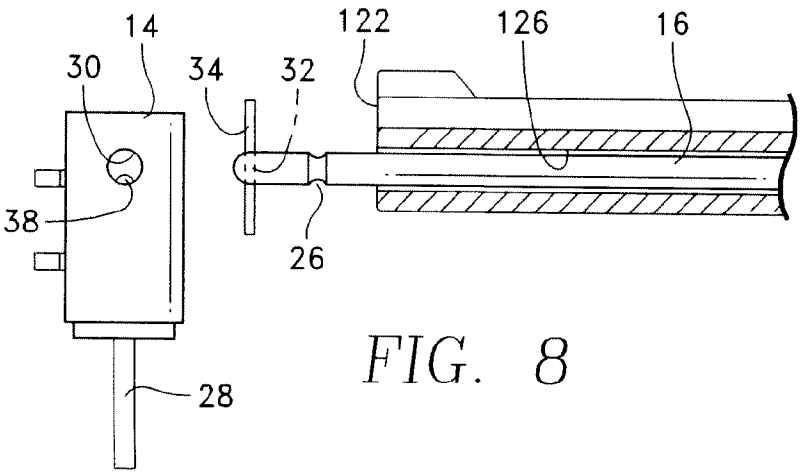
FIG. 8 shows a side view of an embodiment of a lock body and showing how a tool might be utilized to remove and install the rod.

Lock body 14 has an opening 30 for receiving a portion of outward end 22. As indicated in FIG. 8, lock body 14 has a locking mechanism which may have a latch 38 which engages the circumferential groove 26. When the latch engages circumferential groove 26, the lock body 14 is prevented from being removed from outward end 22. As shown in FIGS. 3-7, the lock body 14 is installed such that the lock body directly abuts the muzzle 122, 132, 142, 152 leaving, at most, a minimal length of rod 16 exposed between lock body 14 and the muzzle, such that any exposed length of rod is insufficient for attachment or grasping by any commonly known type of tool to allow grasping and rotating rod 16 and the disengagement of threaded end 18 from threaded aperture 20, 20', of 20". When the latch engages circumferential groove 26, the lock body 14 spins freely on rod 16, such that rotation of the lock body 14 will not cause any rotation in rod 16.

Figure 9:
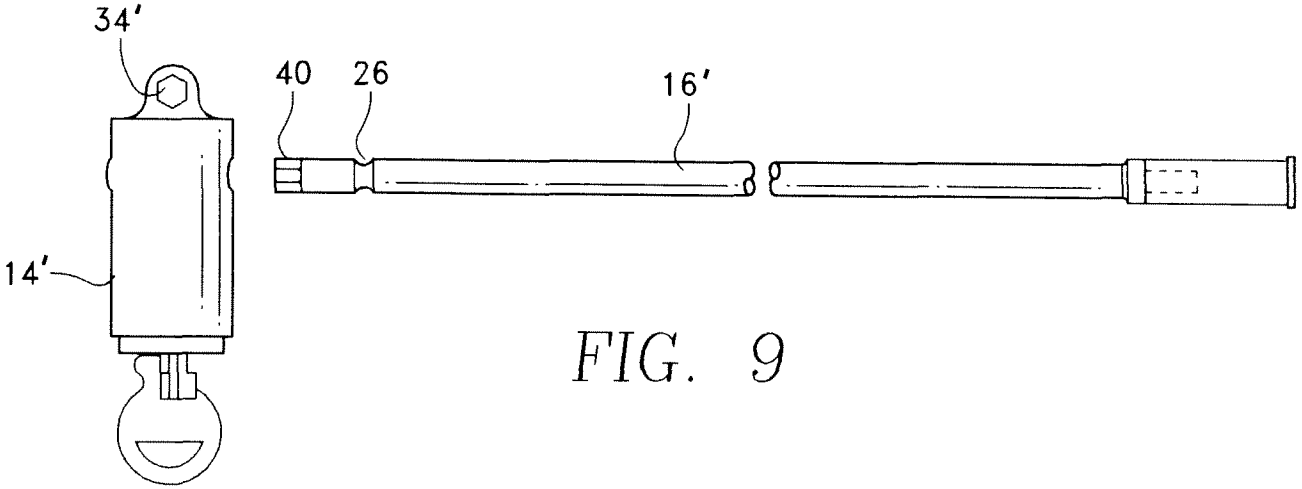
FIG. 9 shows an alternative embodiment of the device with an integral rod turning tool.
Figure 10:
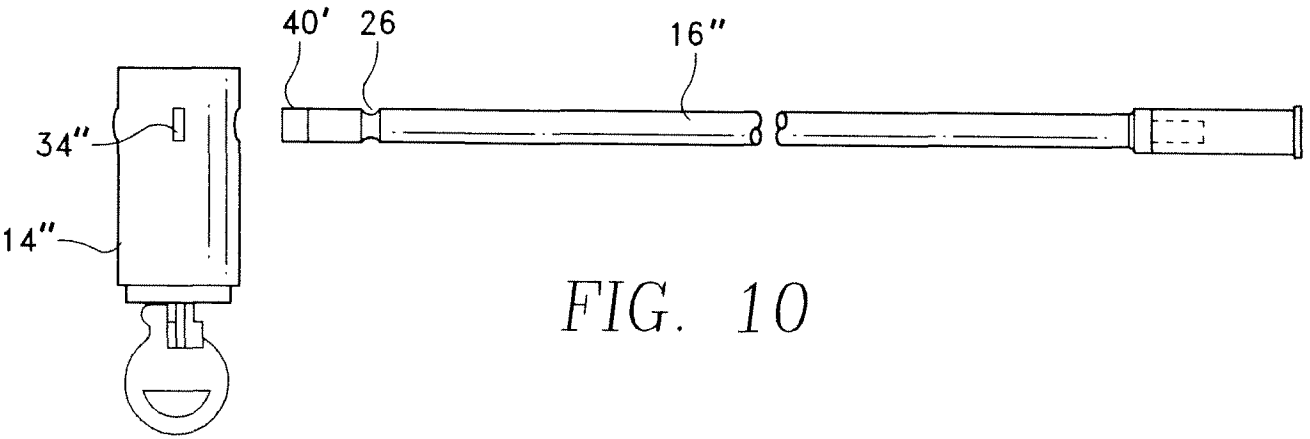
FIG. 10 shows an alternative embodiment of the device having a different variety of integral turning tool.

Rod 16 may have an aperture 32 which allows the insertion of a pin 34 which facilitates rotation of the rod when the lock mechanism of lock body 14 is released and the lock body 14 is removed from the rod. As shown in FIG. 1, the pin 34 may be retained to lock body 14 by opposing clips 36 which are built into the side of lock body 14. FIGS. 9-10 show alternative embodiments of the device having a lock body 14', 14" having integral rod rotation tools. FIG. 9 shows a lock body 14' having a wrench 34' which may engage a corresponding tool end 40 at the outward end of the rod 16'. The wrench 34' may have a variety of tool engaging apertures, including hex, torx, square and three sided. FIG. 10 shows a lock body 14" having an opening 34" which may receive a bladed tool end 40' of the rod 16".

Once lock body 14 is removed, the pin 34 may be inserted into aperture 32 and the rod 16 rotated, typically counterclockwise, to disengage the threads of threaded end 18 from threaded aperture 20, 20', of 20" such that rod 16 may be withdrawn from the barrel of the weapon. Once rod 16 has been removed, the casing body 12, 12', or 12" may be removed from the chamber 124, 134, 144, or 154 of the weapon.

The locking mechanism of lock body 14 may be operated by a key 28. The lock portion of a MASTERLOCK coupler latch lock set, part number 2848DAT, provides a suitable lock body 14. This lock is typically utilized to lock a ball hitch within a housing attached to a towing vehicle, having no application for use with fire arms. Alternatively, as shown in FIG. 7, an embodiment of lock body **14*a* may be operated by a combination mechanism which sets and releases the latch which engages circumferential groove 26 of rod 16**.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following appended claims.

What is claimed is:

1. A firearm locking apparatus comprising:

a casing body having a front and a back, the front having an axially aligned threaded aperture facing toward a muzzle of the firearm when the casing body is disposed within a firing chamber of the firearm;

a rod having a first threaded end and a second end, wherein the first end comprises threads and a shoulder member adapted to screw into the threaded aperture of the casing body, such that the shoulder member abuts the front of the casing body when the threads are fully made up into the threaded aperture, the second end of the rod comprising a circumferential groove, wherein the distance between the shoulder member and the circumferential groove is L;

a lock body having an opening for receiving the second end of the rod, the lock body further comprising a locking mechanism having a latch which engages the circumferential groove which, upon engagement, prevents the lock body from being removed from the second end, but allows the lock body to spin on the second end of the rod, wherein L is dimensioned such that when shoulder member abuts the front of the casing body and the latch engages the circumferential groove, the lock body abuts the muzzle of the firearm.

2. The firearm locking apparatus of claim 1 wherein the latch engages the circumferential groove upon rotation of a key within the locking mechanism.

3. The firearm locking apparatus of claim 1 wherein the latch engages the circumferential groove upon the insertion of a portion of the rod into the opening of the lock body.

4. The firearm locking apparatus of claim 1 wherein the latch disengages the circumferential groove upon rotation of a key within the locking mechanism.

5. The firearm locking apparatus of claim 1 wherein the latch disengages the circumferential groove upon entry of a correct combination into the lock body.

6. The firearm locking apparatus of claim 1 wherein the second end of the rod comprises a tool engagement means.

7. The firearm locking apparatus of claim 6 wherein the tool engagement means comprises an aperture penetrating through the second end of the rod.

8. The firearm locking apparatus of claim 7 wherein the lock body comprises a pair of opposing clips adapted to removably receive a pin which fits within the aperture.

9. The firearm locking apparatus of claim 6 wherein the tool engagement means comprises the second end of the rod having a profile selected from the group consisting of a hexagonal profile, a torx profile, a square profile, and a three-sided profile.

10. The firearm locking apparatus of claim 9 wherein the lock body comprises an integral tool member extending from an end of the lock body, the tool member having an opening which corresponds to the profile of the rod.

11. The firearm locking apparatus of claim 6 wherein the tool engagement means comprises the second end of the rod having a slotted end.

12. The firearm locking apparatus of claim 11 wherein the lock body comprises an integral screw driver blade which fits within the slotted end.

13. A method of locking a firearm to prevent discharge of the firearm by an unauthorized person, the firearm comprising a firing chamber, a barrel, and a barrel muzzle, the method comprising the steps of:

placing a casing body within the firing chamber, the casing body comprising an axially aligned threaded aperture oriented toward the muzzle;

inserting a rod having a first end having threads into the barrel, the rod having a second end with a circumferential groove;

screwing the threads of the rod into the axially aligned threaded aperture of the casing body, leaving a portion of the rod, including the second end with the circumferential groove, extending outside of the muzzle;

attaching a lock body to the portion of the rod extending outside of the muzzle, wherein the lock body has a locked position in which a latch engages the circumferential groove and an unlocked position in which the latch disengages from the circumferential groove, wherein in the locked position the lock body spins on the rod; and locking the lock body to engage the latch with the circumferential groove, with the lock body abutting the muzzle of the firearm.

14. A firearm locking apparatus to be used in combination with a firearm, the firearm comprising a firing chamber, a barrel, and a barrel muzzle, the firearm locking apparatus comprising:

a casing body comprising a long axis which, when disposed within the firing chamber, is axially aligned with the barrel, the casing body having no bullet, propellant or primer, the casing body further comprising a front and back, the casing body comprising an axially aligned threaded aperture having an opening at the front of the casing body, the casing body further comprising a rim portion which prevents forward movement towards the barrel muzzle by the casing body when the casing body is disposed within the firing chamber of the firearm;

a rod having a first threaded end and a second end, wherein the first end is adapted to screw into the threaded aperture of the casing body and the second end comprises a circumferential groove;

a lock body having an opening for receiving the second end of the rod, the lock body further comprising a locking mechanism having a latch which engages the circumferential groove which, upon engagement, prevents the lock body from being removed from the second end, but allows the lock body to spin on the second end of the rod, wherein the circumferential groove is positioned on the second end of the rod such that when the latch engages the circumferential groove, the lock body abuts the barrel muzzle.

* * * * *